United States Patent [19]

Sattelberg

[11] 3,987,925

[45] Oct. 26, 1976

[54] INSULATED TANK

[75] Inventor: Stanley E. Sattelberg, Naperville, Ill.

[73] Assignee: Chicago Bridge & Iron Company, Oak Brook, Ill.

[22] Filed: Aug. 11, 1975

[21] Appl. No.: 603,527

[52] U.S. Cl. ..... 220/9 LG; 220/15

[51] Int. Cl.[2] ..... B65D 87/24; B65D 25/18

[58] Field of Search ..... 220/9 A, 9 LG, 10, 15; 114/74 A

[56] References Cited

UNITED STATES PATENTS

| | | | |
|---|---|---|---|
| 2,959,318 | 11/1960 | Clark et al. | 114/74 A X |
| 3,147,878 | 9/1964 | Wissmiller | 220/15 X |
| 3,362,559 | 1/1968 | Kottring | 220/9 LG |
| 3,913,775 | 10/1975 | Ozaki | 220/9 LG |
| 3,935,957 | 2/1976 | Hasegawa | 220/9 LG |

FOREIGN PATENTS OR APPLICATIONS

| | | | |
|---|---|---|---|
| 234,484 | 7/1961 | Australia | 220/9 LG |
| 1,183,891 | 3/1970 | United Kingdom | 220/15 |

*Primary Examiner*—William Price
*Assistant Examiner*—Stephen Marcus
*Attorney, Agent, or Firm*—Merriam, Marshall, Shapiro & Klose

[57] ABSTRACT

A storage tank having an inner shell, an outer shell surrounding and spaced from the inner shell, a flexible main membrane between the inner shell and the outer shell, granular insulation between the inner shell and the membrane, and tension line means girding the membrane and pressing it into contact with the granular insulation. The tank can be spherical, cylindrical or other shape.

5 Claims, 4 Drawing Figures

INSULATED TANK

This invention relates to insulated storage tanks for storing hot or cold materials. More particularly, this invention is concerned with improvements in storage tanks having outer and inner shells and insulation between the shells.

Storage tanks are used for storing various materials at temperatures which are either higher or lower than ambient temperature. To maintain the desired storage temperature, or to reduce liquid boil-off, insulation is used to retard heat leak.

One particular type of tank, especially useful for storing liquefied gases at low temperatures, employs an outer shell and an inner shell with insulation between the shells. The resulting tank is generally spherical or cylindrical. In a spherical tank both shells are usually concentrically positioned. A cylindrical tank has two spaced apart shells with each shell having a flat bottom and cylindrical wall. Both shells can have separate, independent domed or conical roofs or the inner shell can have a roof suspended from a roof supported by the outer shell.

Regardless of the particular type of tank, whether it be spherical or cylindrical, granular insulation material, such as perlite, is usually placed between the inner and outer shells. This, however, leads to compaction of the granular insulation through cycling of the inner shell from ambient temperature to cold storage temperatures and back to ambient temperature because of the contraction and expansion of the inner shell with temperature change. One way to eliminate this problem is to use a resilient blanket in the space between the inner and outer shells as disclosed in Wissmiller U.S. Pat. No. 3,147,878.

The use of a resilient blanket satisfactorily reduces compaction of the granular insulation and also reduces build-up of pressure against the shell walls of the tank. However, the springing property of the resilient blanket generates a pressure against the inner and outer shells which must be taken into account in designing the tank. Shell stiffening for this pressure often adds a significant amount to the capital cost of the storage tank. There is thus a need for an improved double shell insulated storage tank which will avoid the necessity of using a resilient blanket between inner and outer shells but which will still permit utilization of the inexpensive, readily available and easily installed granular type of insulation.

According to the present invention there is provided an improved insulated double shell storage tank which eliminates the use of a resilient blanket between the inner and outer shells. The storage tank comprises an inner shell, an outer shell surrounding and spaced from the inner shell, a flexible main membrane between the inner shell and the outer shell, granular insulation between the inner shell and the membrane, and tension line means girding the membrane and pressing it into contact with the granular insulation.

The tension line means can include a plurality of spaced apart lines which criss-cross the membrane, such as in a grid-like pattern made of vertical and horizontal lines. Alternatively, all of the lines can run, more or less, in the same direction, such as vertical or horizontal and the membrane can be designed to resist all the tension applied to it between adjacent lines, such as adjacent parallel lines.

the storage tank of this invention can be spherical and made of two concentrically positioned spherical metal shells. The storage tank can also be cylindrical. A cylindrical storage tank according to the invention has an inner shell having a bottom and a vertical wall joined thereto and an outer shell, surrounding and spaced from the inner shell, with a bottom, a vertical wall joined to the bottom and a roof joined to the top of the vertical wall. The inner and outer shell bottoms have load bearing insulation between them. An insulation means is provided over the space defined by the inner shell wall. This insulation means may comprise a suspended insulated ceiling which hangs horizontally from supporting rods which depend downwardly from the outer shell roof. Alternatively, the insulation means can be a conical or domed inner roof supported by the inner shell wall.

The double shelled cylindrical tank of the subject invention has a vertical flexible membrane located between the inner shell wall and the outer shell wall. The membrane extends from about the outer shell roof to the bottom of the outer shell. Granular insulation is positioned between the inner shell wall and the membrane. The granular insulation extends from the outer shell bottom to at least near the top portion of the inner shell wall and advisably up to and even above the top edge of the inner shell wall. To maintain the granular insulation in position and to reinforce the vertical membrane, tension line means is provided girding the membrane and pressing it into contact with the granular insulation. When the tank is filled with a liquefied gas the membrane remains at ambient temperature while the inner shell cools. The tension line means pulls the entire granular insulation mass inwardly with shrinkage of the inner shell and compresses the granular insulation slightly in the circumferential direction. This compression is partly relieved by thermal contraction of the perlite. The resulting small movements and intergrain forces will cause even less breakdown of the granular insulation than the insignificant amount observed in the systems which employ the previously described resilient blanket.

In a spherical tank according to the invention the membrane is spaced between the inner and outer spherical shells. The membrane itself, in position, is spherically shaped and approximately uniformly spaced outwardly from the inner shell but inwardly from the outer shell. Granular insulation is placed between the membrane and the inner shell to completely fill the space between them. Tension line means girds the membrane and presses it into contact with the granular insulation. As a result the granular insulation is held in position upon contraction of the inner shell upon cooling and subsequent expansion of the shell upon warming.

The described insulating system results in a substantial saving by eliminating use of a resilient blanket and by elimination of the otherwise required shell stiffening to withstand the increase in pressure above the passive pressure of the granular insulation that is inevitable in the resilient blanket insulation system.

The tension line means girding the membrane need only be designed for the forces generated by the passive pressure and the vertical drag of the granular insulation because it will prevent the granular insulation from contacting the outer shell at any time, including during maximum movement of the inner shell relative to the outer shell. Any stiffeners that are required in a cylindrical shell can be welded on the outside or inside of the inner shell wall. There is, of course, some sacrifice of granular insulation space because of the void space which is required between the membrane and the outer shell.

The invention will be described further with respect to the attached drawings, in which.

The same parts or elements which appear in the different views of the drawings will be identified by the same numbers.

Figure 1:
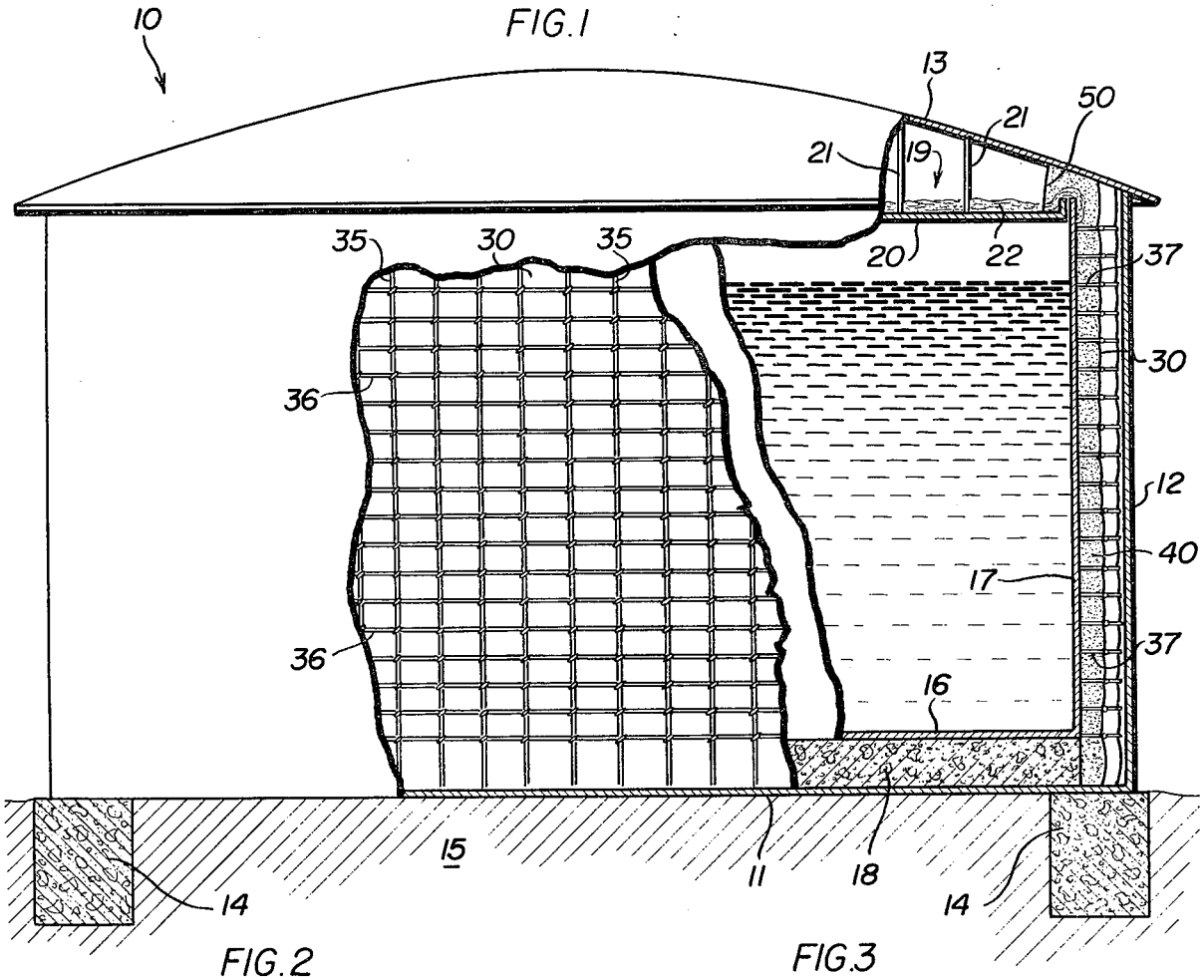
FIG. 1 is an elevational view, partially in section and partially cut away, of an insulated double shelled storage tank which employs a vertical membrane according to the invention between the inner and outer shell walls.

The insulated storage tank 10 shown in the drawings has an outer shell comprising a circular flat metal bottom 11 to which the lower edge of vertical metal wall 12 is joined. Domed outer roof 13 of metal plate is joined to the upper edge of outer shell wall 12 to thereby complete the outer shell. The outer shell bottom 11 is supported by a load bearing base 15 and a pheripheral concrete foundation 14.

The inner shell of tank 10 has a flat circular bottom 16 of metal plate to which the lower edge of inner shell wall 17 is joined about its peripheral circular edge. Load bearing insulation 18 is positioned between outer shell bottom 11 and inner shell bottom 16. The top of the inner shell is insulated by means of a suspended insulated ceiling 19. The insulated suspended ceiling 19 includes a horizontal metal deck 20 which is connected to vertical rods 21 which are suspended at their upper ends from the lower surface of outer shell roof 13. Insulation 22 is placed on top of deck 20 to thereby insulate the space beneath the deck from the space there above. The insulation 22 is extended over the top peripheral edge 23 of the deck 20 and over the top edge 24 of inner shell wall 17 by means of an insulating blanket and a flexible membrane. In this way granular insulation is prevented from falling between the two edges during expansion and contraction of the respective parts.

Positioned between the outer shell wall 12 and the inner shell wall 17 is a vertical flexible main membrane 30. Any suitable material can be used for the membrane. It can be a solid film of suitable thickness or a woven cloth like material, such as of glass fibers. The flexible membrane 30 is spaced inwardly from outer shell wall 12 and thus does not apply pressure thereto. The vertical membrane 30 extends from the surface of outer shell bottom 11 upwardly to the lower surface of outer shell roof 13, although in some instances it may not be necessary to extend the membrane 30 up quite that high.

A plurality of spaced-apart vertical lines 35 are joined to the outer shell bottom 11 and to the lower surface of outer shell roof 13. The vertical lines 35 are advisably positioned parallel to identical adjacent such lines all around the cylindrically shaped membrane 30. A plurality of horizontal lines 36, spaced apart from such adjacent lines, extend around the membrane 30 circumferentially and cross the vertical lines 35 to thereby provide a grid structure of lines in contact with the membrane 30 to provide lateral reinforcement or support for it. A series of lateral ties 37 extend outwardly from inner shell wall 17, to which they are connected, and they are joined to lines 35 and 36 at the points of intersection. The ties 37 are advisably made of nonmetallic material so that heat flow into the tank is retarded. The lines can be made of glass fibers, nylon or some other suitable material.

Granular insulation 40, such as perlite, is placed between vertical flexible membrane 30 and inner shell wall 17 to fill the space from outer shell bottom 11 up to and above the top edge 24 of the inner shell wall. The horizontal circumferential lines 36 are placed in tension by the granular insulation 40 which is retained between the flexible membrane 30 and the inner shell wall 17. As a result, when the inner shell of the tank contracts, such as when employed for the storage of a cryogenic liquid, the granular insulation 40 stays in position relative to wall 17, and moves inwardly simultaneously with contraction of the wall. Since the flexible membrane 30 is tied to the inner wall 17, the entire mass of wall 17, insulation 40 and flexible membrane 30 move simultaneously as a unit. The compression on the granular insulation is partly relieved by thermal contraction of the granular insulation as the tank is cooled and the inner shell contracts. The result is that there is very little breakdown of the granular insulation or settling of the insulation in service. It is not likely that the addition of more granular insultion during service of the tank would be required.

The membrane supporting grid work of lines or cables 35 and 36 need only be designed to withstand the passive pressure, and the vertical drag, of the granular insulation. Since the membrane and the supporting system of lines is intended to remain out of contact with the outer shell wall there is no need for supplemental means to strengthen the outer shell wall against pressure applied by the granular insulation 40.

A flexible vertical circular upper membrane 50 is provided which extends from the bottom surface of the outer shell roof 13 to the peripheral portion of the insulated ceiling deck 20. Vertical lines or bars 51 joined to the roof 13 and the deck 20 serve to reinforce membrane 50 so that it can withstand pressure applied by the granular insulation which presses against it. The membrane 50 retains granular insulation in place.

Although the described insulating system is particularly useful in tanks for storing cryogenic liquids it is also obviously useful for storing liquids heated substantially above the surrounding atmospheric or ambient temperature. Sufficient space is provided between outer shell wall 12 and membrane 30 so that upon expansion of inner shell wall 17 the membrane is not brought into contact with wall 12.

Figure 4:
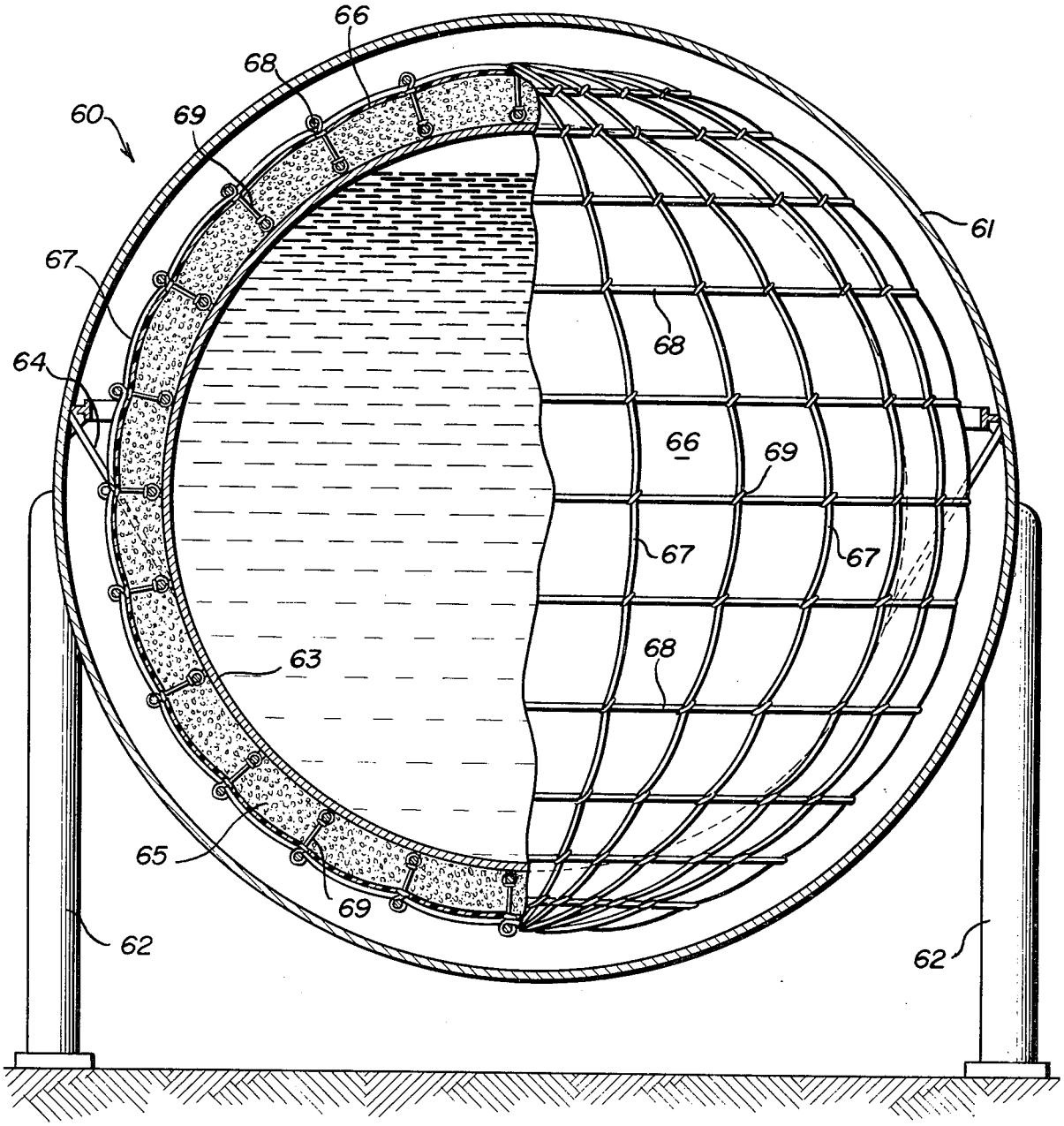
FIG. 4 is an elevational view, partially in section, of a spherical tank.

With reference to FIG. 4, the spherical tank 60 has an outer spherical metal shell 61 supported by a plurality of vertical columns 62. Inner spherical metal shell 63 is suspended by a plurality of rods 64 joined to the inside of outer shell 61. The inner and outer shells 63 and 61 are advisably concentrically positioned relative to each other.

Surrounding the outer surface of inner shell 63 is a layer of granular insulation 65 which can be of uniform thickness. Flexible membrane 66 completely surrounds or envelopes the insulation 65 and is in surface contact therewith.

Vertical tension lines 66 are equally positioned apart radially around membrane 67 and are joined at their top and bottom ends to a ring or metal disc (not shown) to avoid overlapping an excess number of tension lines.

Spaced-apart horizontally positioned tension lines 68 also surround membrane 66 and cross vertical lines 67 more or less laterally. Radially positioned ties 69 are connected at their inner end to the surface of inner shell 63 while the outer end is secured to the intersection of a line 68 with a line 67 to thereby jointly hold adjacent portions of the lines in position.

Figure 2:
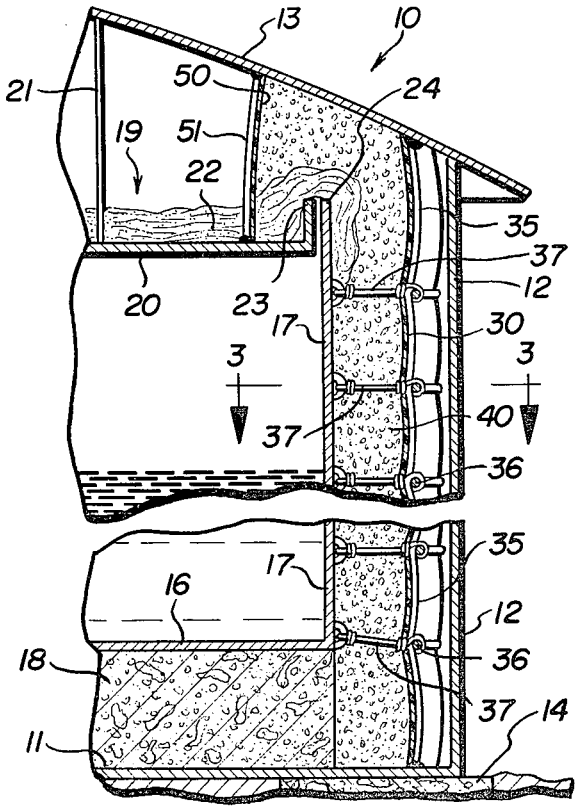
FIG. 2 is a vertical broken-away sectional view through the side walls of the inner and outer shells of the tank of FIG. 1.
Figure 3:
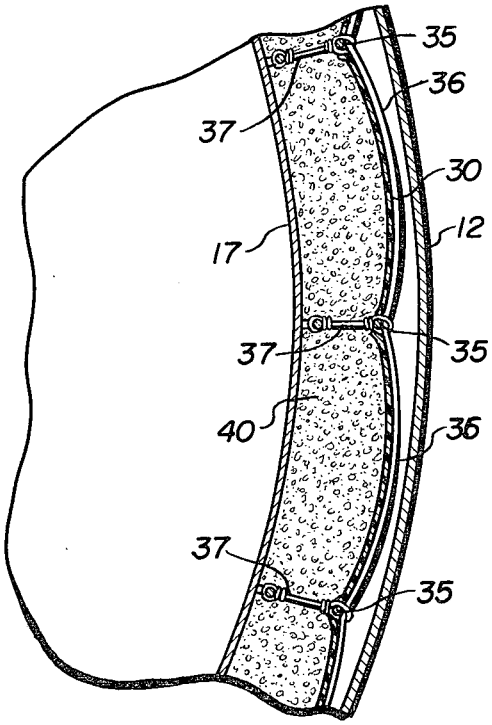
FIG. 3 is a horizontal sectional view taken along the line 3—3 of FIG. 2.

The described insulation system for tank 60 operates in the same way as the system described with reference to FIGS. 1 to 3 so it will not be described herein again.

The tanks as illustrated by the drawings do not include ancillary elements which tanks as built for commercial use would have. For example, filling and emptying pipes and vent pipes have not been shown for clarity since those skilled in the art would include those elements as appropriate in the tanks.

The foregoing detailed description has been given for clearness of understanding only, and no unnecessary limitations should be understood therefrom, as modifications will be obvious to those skilled in the art.

What is claimed is:

1. A storage tank comprising:

an inner shell;

an outer shell surrounding and spaced from the inner shell;

a flexible main membrane between the inner shell and the outer shell;

granular insulation between the inner shell and the membrane; and tension line means girding the membrane and pressing it into contact with the granular insulation.

2. A storage tank according to claim 1 in which:

both shells are concentrically positioned spherical shells; and the tension line means includes a plurality of spaced apart lines circumscribing the membrane in a grid-like pattern.

3. A storage tank comprising:

an inner shell having at least a bottom and a vertical wall joined thereto;

an outer shell, surrounding and spaced from the inner shell, having a bottom, a vertical wall joined to the bottom and a roof joined to the top of the vertical wall;

insulation between the inner shell bottom and the outer shell bottom;

a vertical flexible main membrane between the inner shell wall and the outer shell wall extending from about the roof to the bottom of the outer shell;

granular insulation between the inner shell wall and the membrane;

tension line means girding the membrane and pressing it into contact with the granular insulation; and insulation means over the space defined by the inner shell wall.

4. A storage tank according to claim 3 in which:

both shell walls are concentrically positioned cylindrical walls; and the tension line means includes a plurality of horizontally located spaced apart lines circumscribing the membrane and a plurality of vertically positioned spaced apart lines joined to the roof and bottom of the outer shell.

5. A storage tank according to claim 4 in which ties extend from the inner shell wall to the horizontal and vertical lines.

* * * * *